US006344239B1

(12) United States Patent
Asai et al.

(10) Patent No.: US 6,344,239 B1
(45) **Date of Patent: *Feb. 5, 2002**

(54) METHOD FOR PRODUCING A TOBACCO FILTER MATERIAL

(75) Inventors: Tanemi Asai, Ibo-gun; Syu Shimamoto, The Hague; Hiroyuki Matsumura; Tohru Shibata, both of Himeji, all of (JP)

(73) Assignee: Daicel Chemical Industries, Ltd., Osaka (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/175,464

(22) Filed: Oct. 20, 1998

Related U.S. Application Data

(62) Division of application No. 08/532,280, filed on Sep. 22, 1995, now Pat. No. 5,856,006.

(30) Foreign Application Priority Data

Sep. 22, 1994 (JP) ..... 6-254557
Oct. 18, 1994 (JP) ..... 6-280053

(51) Int. Cl.[7] ..... B05D 7/00; B23B 23/00; A24B 15/28; B01D 39/00

(52) U.S. Cl. ..... 427/212; 427/421; 427/430.1; 131/342; 131/345; 428/375; 428/378; 428/393; 210/500.3; 210/504; 210/505; 210/506; 210/508

(58) Field of Search ..... 427/212, 421, 427/430.1; 131/332, 342, 345; 210/500.3, 504, 505, 506, 508; 428/375, 378, 393

(56) References Cited

U.S. PATENT DOCUMENTS

| | | | | |
|---|---|---|---|---|
| 3,900,037 A | | 8/1975 | Horsewell et al. | |
| 4,085,760 A | | 4/1978 | Toyoshima et al. | |
| 4,192,838 A | * | 3/1980 | Keith et al. | 264/10 |
| 5,048,546 A | * | 9/1991 | Hsu et al. | 131/331 |
| 5,150,721 A | * | 9/1992 | Lee et al. | 131/331 |
| 5,427,852 A | | 6/1995 | Teufel et al. | |
| 5,478,386 A | | 12/1995 | Itoh et al. | |
| 5,706,833 A | * | 1/1998 | Tsugaya et al. | 131/332 |
| 5,720,803 A | * | 2/1998 | Itoh et al. | 106/168.01 |
| 5,947,127 A | * | 9/1999 | Tsugaya et al. | 131/332 |

FOREIGN PATENT DOCUMENTS

| | | |
|---|---|---|
| DE | 43 22 965 C1 | 10/1994 |
| EP | 0 597 478 A1 | 5/1994 |
| FR | 2 324 247 | 4/1977 |
| GB | 919053 | 2/1963 |
| JP | B-44-1953 | 1/1944 |
| JP | B-44-1944 | 1/1969 |
| JP | B-50-38720 | 12/1975 |
| JP | 52-38098 | 3/1977 |
| JP | A-52-72900 | 6/1977 |
| JP | A-52-96208 | 8/1977 |
| JP | A-53-45468 | 10/1977 |
| JP | A-55-141185 | 4/1979 |
| JP | A-5 227939 | 9/1993 |

OTHER PUBLICATIONS

Japanese Standards Association, 'Pulps–Determination of Drainability', UDC 676.1:676.017.3:539.217 (JIS P 8121) (1995).

Japanese Standards Association, 'Determination of Basis Weight of Paper', UDC 676.017:531.753 (JIS P 8124) (1976).

Database WPI, Week 8049, Derwent Publications Ltd., London, GB (JP–A–55–135582).

Database WPI, Week 8050, Derwent Publications Ltd., London, GB (JP–A–55–138385).

Database WPI, Week 9502, Derwent Publications Ltd., London, GB (JP–A–06–299407).

* cited by examiner

*Primary Examiner*—Bret Chen
(74) *Attorney, Agent, or Firm*—Pillsbury Winthrop LLP

(57) ABSTRACT

A method for producing a tobacco filter material which is either (A) a coating process for coating the surface of a fibrous or particulate cellulose with a cellulose ester having an average substitution degree of about 2.0 to about 2.6 to give a coated cellulose, and wet webbing the coated cellulose into a sheet, or (B) a treating process for treating a naturally-occurring or regenerated cellulose fiber or particle with an organic acid and an organic acid anhydride or organic acid halide in a liquid phase to give a cellulose derivative.

11 Claims, No Drawings

METHOD FOR PRODUCING A TOBACCO FILTER MATERIAL

This is a continuation of application No. 08/532,280, filed Sep. 22, 1995 now U.S. Pat. No. 5,856,006.

FIELD OF THE INVENTION

The present invention relate to a tobacco filter material with very satisfactory biodegradability, wet disintegratability or other characteristics, a method for producing the tobacco filter material, and a tobacco filter insuring a good aroma and palatability of tobacco smoke as produced using the filter material.

BACKGROUND OF THE INVENTION

As a tobacco filter which serves an effective removal of harmful components of the tobacco such as tar, and insures a satisfactory smoking quality, a filter plug prepared by shaping a tow (fiber bundle) of a cellulose acetate (e.g. a cellulose acetate having an average degree of substitution of about 2.4) fiber with a plasticizer such as triacetin is known. In this filter plug, however, the biodegradability is low, and the constituent filaments have been partly fused together by the plasticizer so that when it is discarded after smoking, it takes long time for the filter plug to disintegrate itself in the environment, thus adding to the pollution problem. Moreover, such filter plug discarded can hardly be completely recovered and would entail an almost prohibitive cost of recovery. Disposal of filter plug by incinerating involves large out-puts of combustion heat which detract considerably from the serviceable life of the incinerator.

Meanwhile, a tobacco filter made of a sheet-form or creped paper manufactured from a wood pulp and a tobacco filter made from a regenerated cellulose fiber are also known. Compared with a filter plug comprising a tow (fiber bundle) of a cellulose acetate fiber, these filters are meritorious in biodegradability and slightly more wet-disintegratable (wet-disintegrative) and, thus, of somewhat lower pollution potential. However, in these filters, not only the aroma (taste) and palatability of tobacco smoke are sacrificed but also the efficiency of selective elimination of phenols which is essential to tobacco filters car hardly be expected when compared with the cellulose acetate filter. Moreover, the firmness or hardness of these filters is lower than that of the cellulose acetate filter on a give pressure loss basis. Furthermore, such material in the form of a sheet manufactured from a wood pulp has a low bulkiness, and hence imparting a higher bulkiness to the material in order to decrease the pressure loss causes fuzz or scuffing and low moldability.

Japanese Patent Application Laid-open No. 45468/1978 (JP-A-53-45468) corresponding to U.S. patent application Ser. No. 7,30039 discloses a filter material comprising a nonwoven sheet containing 5 to 35% by weight of cellulose ester fibrils with a large surface area and 65 to 95% by weight of cellulose ester short staples. Furthermore, this prior art literature mentions that a wood pulp may be incorporated in this mixture of cellulose ester fibrils and cellulose ester short staples. However, because cellulose esters can hardly be processed into fine fibrils, a special technique is required for providing the fibrils with a large surface area. Moreover, the disintegratability and biodegradability of this filter material are not sufficiently high so that the risk of pollution is substantial.

Japanese Patent Application Laid-open No. 141185/1980 (JP-A-55-141185) discloses a filter material comprising a composite sheet-like entity manufactured by sealing or adhering a sheet-like entity comprising mainly wood pulp fibers, and a sheet-like entity comprising a tow of cellulose ester derivative fibers. However, in such filter material, although somewhat improved aroma and palatability of tobacco smoke can be obtained, the molding of the sheet-like entity and the sealing or adhering of the both sheets are conducted with the use of a plasticizer such as triacetin so that the fibers each other and the sheets each other are fused to fail to provide a sufficient wet disintegratability.

Furthermore, a tobacco filter material in a sheep form is occasionally subjected to creping or other processing during molding or shaping processes, and such tobacco filter material is required to retain a high dry strength during the processing or dry handling but, then, its wet disintegratability is low. By the same token, a sheet material providing for a high degree of wet disintegratability shows only a low strength even in dry handling condition.

Meanwhile, Japanese Patent Application Laid-open No. 227939/1993 (JP-A-5-227939) discloses a cigarette filter made of a biodegradable aliphatic polyester with fine pores for alleviating the pollution burden on the environment. This filter provides somewhat enhanced biodegradability. The aroma and palatability of tobacco smoke in such filter are, however, sacrificed in comparison with the cellulose acetate filter plug.

Japanese Patent Application Laid-open No. 72900/1977 (JP-A-52-72900) discloses a tobacco filter comprising an aggregate of fibrous acetylated cellulose having an average degree of acetylation in the range of 10 to 50%. This literature mentions that the fibrous acetylated cellulose is obtained by acetylating a cellulose fiber such as pulp with the use of a catalyst for acetylation such as sulfuric acid. However, the fiber obtained by such technique is not sufficient in the biodegradability yet being excellent in the aroma and palatability of tobacco smoke.

Japanese Patent Publication No. 1944/1969 (JP-B-44-1944) discloses a tobacco filter which is produced by adding a solution containing a hydrophobic polymer to a paper by means of impregnation or spraying and shaping the resultant paper into a rod-shape in order to improve the firmness and elasticity (springiness) of paper filters. The smoking quality of such tobacco filter may provably be improved. However, since the constituent fibers or other component of the paper are adhered or coated due to the addition of the hydrophobic polymer, the wet disintegratability of the filter is remarkably sacrificed.

Thus, excellent characteristics for a tobacco filter such as good smoking quality, the high elimination efficiency of harmful components and the high dry strength, and high biodegradability and/or wet disintegratability can hardly be reconciled in a conventional tobacco filter.

SUMMARY OF THE INVENTION

It is, therefore, an object of the present invention to provide a tobacco filter material which does not detract from the aroma, taste and palatability of tobacco smoke and is highly biodegradable and, hence, contributory to mitigation of the pollution problem and a method for producing the same.

It is another object of the present invention to provide a tobacco filter material which insures an efficient elimination of harmful components in tobacco smoke in addition to having the excellent characteristics as mentioned above and a method of manufacturing such filter material.

A further object of the present invention is to provide a tobacco filter material which does not deteriorate smoking quality and provides for excellent wet disintegratability and biodegradability of the filter and, hence, alleviate the pollution burden on the environment and a method for producing such filter material.

It is yet another object of the present invention to provide tobacco filter material which disintegrates itself readily and fast when wetted despite its great dry strength and a method for its production.

It is still further object of the present invention to provide a tobacco filter material which insures an efficient elimination of harmful components in tobacco smoke and has an adequate puff resistance (pressure drop).

Yet another object of the present invention is to provide a tobacco filter having the above-mentioned meritorious characteristics.

The inventors of the present invention did an intensive research to accomplish the above-mentioned objects noting that the surface of a material participates or relates to an improvement of the smoking quality of a filter, and found that a coated cellulose prepared by coating the surface of a fibrous or particulate cellulose with a cellulose ester does not deteriorate the aroma and palatability of tobacco smoke and provides efficient elimination of harmful components in tobacco smoke and that such filter material is readily disintegrated by water such as rain water in the natural environment and is degraded biologically. They also found that a fibrous or particulate cellulose derivative which is esterified only in the surface thereof does not deteriorate smoking quality (e.g. aroma, taste, palatability) and shows high degradability (disintegratability) in the natural environment. The present invention has been accomplished on the basis of the above findings.

Thus, the tobacco filter material of the present invention is a filter material comprising a fiber or particle having a core and a surface layer surrounding said core, wherein said surface layer comprises a cellulose ester and said core comprises a non-esterified cellulose.

In such fiber or particle, the cellulose ester in the surface layer may for example be an ester with an organic acid having about 2 to 4 carbon atoms (e.g. a cellulose acetate). The non-esterified cellulose in the core may comprise a wood pulp. The filter material is generally used in the sheet form having a web structure and may optionally be creped or embossed.

By way of illustration, the fiber or particle in the filter material may be (A) a coated cellulose of a fibrous or particulate cellulose coated with a cellulose ester. The coating amount of the cellulose ester in the coated cellulose (A) may be selected from a wide range and is, for example, not less than 0.1% by weight based on the total amount of the coated cellulose (A).

The fiber or particle may also be (B) a fibrous or particulate cellulose derivative derived from a naturally-occurring or regenerated cellulose fiber or particle, which comprises a core and a surface layer surrounding the core, in which an esterified portion in the surface layer and a non-esterified portion in the core are formed by esterification of the surface of the fiber or particle, and an average degree of substitution of the whole of the cellulose derivative is not more than 1.5.

Such coated cellulose (A), fibrous or particulate cellulose derivative (B) and the filter material comprising such constituent material are biodegradable and show, for example, a 4-week decomposition rate of not less than 20% by weight as determined using the amount of evolved carbon dioxide as an indicator in accordance with ASTM D 5209-91.

The proportion of the coated cellulose (A) or the fibrous or particulate cellulose derivative (B) in the filter material may be selected within a wide range and is, for instance, not less than 30% by weight based on the total amount of the filter material.

The tobacco filter of the invention comprises the tobacco filter material as mentioned above.

The tobacco filter material may be produced by (A) coating the surface of the fibrous or particulate cellulose with the cellulose ester. Such coating may be carried out, for instance, by attaching or adhering the cellulose ester to the surface of the fiber or particle by means of dipping, spraying or other technique and drying the resultant coated cellulose, or by adding a mixture of the cellulose ester and the fibrous or particulate cellulose to a poor solvent for the cellulose ester, or spray-drying the same mixture.

Further, such cellulose derivative (B) which constitutes the filter material may be obtainable by, for example, treating the naturally-occurring or regenerated cellulose fiber or particle with an organic acid and an organic acid anhydride or halide in a liquid phase.

It should be understood that the term "sheet" as used in this specification means any paper-like entity having a two-dimensional expanse that can be taken up in the form of a roll.

In this specification, the term "biodegradation" as used herein includes, within the meaning thereof, a degradation or decomposition process comprising, in any step thereof, biological degradation or decomposition with the aid of an organism such as a microorganism or the like.

DETAILED DESCRIPTION OF THE INVENTION

The filter material of the present invention comprises the above-described fiber or particle as a constituent material.

According to the tobacco filter material of the present invention, the surface of the fiber or particle which contributes to the filtration of tobacco smoke comprises a cellulose ester. Thus, the filtrating characteristics of the material such as the smoking quality and the elimination efficiency of harmful components such as tars are as excellent as those of filters composed of cellulose acetate fibers. Use of the material provides adequate pressure drop (puff resistance) with retaining good moldability. Accordingly, the filter material of the present invention comprising such fiber or particle, in which functions thereof are shared between the surface layer and the core, is characterized in that the reciprocal characteristics, namely the excellent smoking quality and high biodegradability and the like can be reconciled.

Such fiber or particle of the present invention may, as an embodiment, be the coated cellulose (A) and/or the cellulose derivative (B).

The coated cellulose (A) is now described in detail.

The cellulose may be whichever of a naturally-occurring cellulose or a regenerated cellulose. Examples of such cellulose include a naturally-occurring cellulose obtainable from wood fibers [for instance, wood pulp derived from a soft wood (needle-leaved tree) or a hard wood (broad-leaved tree)], seed fibers (e.g. a cotton such as linter, bombax cotton, kapok, etc.), bast fibers (for example, hemp, flax, jute, ramie, paper mulberry and mitsumata (*Edgeworthia papyrifera*)) or leaf fibers (e.g. Manila hemp and New Zealand hemp); a regenerated cellulose such as viscose rayon, cuprammonium rayon and nitrate silk. These species of the cellulose can be used singly or in combination.

The morphology of such cellulose is fibrous form or a particulate form (for example, powdery form). The cellulose in a fibrous form may practically be fibrillated. The fibrillation technique of the cellulose is not critical and, by way of illustration such fibrillation can be achieved in a conventional manner such as beating a raw material for the cellulose, e.g. a wood pulp, with a beating means such as a beating machine. The fibrillated cellulose may further be subjected to refining treatment by permitting an impact force to act thereon to give a refined cellulose (microfibrillated cellulose).

The fiber diameter and fiber length of the fibrous cellulose can suitably be selected from the ranges not interfering with the characteristics as required of the filter. Thus, the fiber diameter of the fibrous cellulose is not particularly restricted, and Practically is from about 0.01 to about 100 $\mu$m and preferably from about 0.1 to about 50 $\mu$m. The fiber length is also not particularly restricted, and whichever length can be employed, and generally is, from about 50 $\mu$m to 10 mm (for instance, from about 50 to 3,000 $\mu$m), and preferably from about 100 to 2,000 $\mu$m.

The cross-sectional configuration of the fibrous cellulose is not specifically restricted and may for example be circular, elliptical or any other configurations. Thus, the fibrous cellulose may be of modified cross-section (e.g. Y-, X-, R- or I-configured) or hollow. The fibrous cellulose may be crimped as necessary and is generally used in the non-crimped form.

The cellulose used in the present invention may preferably be in a fibrous form but particulate (specifically powdery) cellulose may also be employed. The particle size of the particulate cellulose can be selected from a broad range not adversely affecting the moldability (formability) and disintegratability. Thus, the mean particle size of the particulate cellulose is for example about 0.1 to 600 $\mu$m, preferably about 10 to 500 $\mu$m and more preferably about 20 to 250 $\mu$m. If the average particle size is less than 0.1 $\mu$m, the particles tend to be dislodged from the material, while the surface smoothness of the material tends to be sacrificed and the specific surface area of the material tends to be decreased if the limit of 600 $\mu$m is exceeded.

Preferred fibrous or particulate cellulose includes wood fibers, particularly a wood pulp. A conventional pulp can be used as such wood pulp, and the purity of the pulp is not particularly restricted. Thus, whichever of a wood pulp which is highly purified with an $\alpha$-cellulose content of 90% or more, or a wood pulp having a high hemicellulose content such as a paper-grade pulp with a low purity can be employed. The wood pulp may optionally be cracked, or fibrillated by beating. Such wood pulp may also be in a sheet form obtainable by fabricating such fibrillated pulp by a dry or wet fabrication (webbing technique). The degree of beating of the wood pulp may adequately be selected, and a wood pulp having a Canadian standard freeness value, i.e. a freeness value measured by means of Canadian freeness tester, within the range of about 100 to 800 ml and preferably about 150 to 700 ml may practically be utilized. In such wood pulp, the entanglement or interlacing of fibers is increased, and thus the wood pulp has an enhanced strength and high bulkiness with high wet disintegratability.

The fibrous or particulate cellulose is coated in the surface thereof with the cellulose ester to form the coated cellulose. In such coated cellulose, at least a part of the surface of the fiber or particle may be coated with the cellulose ester but the coated cellulose coated homogeneously in the whole of its surface is desirable.

A feature of the coated cellulose (A) of the present invention, in one aspect, resides in reconciling the characteristics as a tobacco filter such as good smoking quality, and excellent biodegradability and wet disintegratability by coating the surface of the fibrous or particulate cellulose with the cellulose ester. That is, in the tobacco filter material comprising the coated cellulose (A), the surface of the fiber or particle which contributes or adds to the filtration of tobacco smoke is coated with the cellulose ester. Thus, the filtrating characteristics of the material such as the smoking quality and the elimination efficiency of harmful components such as tars are as excellent as those of a filter composed of cellulose acetate fibers. The material is also biodegradable as highly as a filter formed with a wood pulp or regenerated cellulose fibers. Further, the coated cellulose can be molded or shaped even without the use of a plasticizer, and hence provides for meritoriously good wet disintegratability. Moreover, the coated fiber or particle has large surface area and thus has high elimination efficiency of the harmful components, and use of the material provides adequate pressure drop (puff resistance) with retaining good moldability.

As examples of the cellulose ester, there may be mentioned organic acid esters such as cellulose acetate, cellulose propionate, cellulose butyrate and the like; inorganic acid esters such as cellulose nitrate, cellulose sulfate, cellulose phosphate, etc.; mixed acid esters such as cellulose acetate propionate, cellulose acetate butyrate, cellulose acetate phthalate and cellulose nitrate acetate; and cellulose ester derivatives such as polycaprolactone-grafted cellulose acetate and so on. These cellulose esters can be used alone or in combination.

As a raw material of the cellulose ester, a variety of celluloses such as the above-exemplified naturally-occurring or regenerated celluloses, e.g. wood pulp can be utilized. The purity of the wood pulp may be whichever of high or low.

The average degree of polymerization (viscosityaverage degree of polymerization) of the cellulose ester may for example be about 10 to 1,000 (e.g. about 50 to 1,000), preferably about 50 to 900 (e.g. about 100 to 800) and more preferably about 200 to 800. When the average degree of polymerization is excessively small, the mechanical strength of the filter material tends to be sacrificed, and if it exceeds the higher limit, not only fluidity and moldability but also biodegradability of the filter material has a tendency to be sacrificed.

The average degree of substitution of the cellulose ester may be selected from a range within about 1 to 3. It should be understood that a cellulose ester grade with an average degree of substitution in the range of about 1 to 2.15, preferably about 1.1 to 2.0, is useful for promoting biodegradability. Meanwhile, the filter material of the present invention with the use of the coated cellulose (A) is characterized by providing for high biodegradability even when a cellulose ester having an average substitution degree of about 2.0 to 2.6 is employed.

Cellulose esters in which the equivalent ratio of residual alkali metal or alkaline earth metal to residual sulfuric acid is about 0.1 to 1.5 and preferably about 0.3 to 1.3 (e.g. about 0.5 to 1.1) has excellent heat resistance and biodegradability. The sulfuric acid is derived from the sulfuric acid used as a catalyst in the production of the cellulose ester. The sulfuric acid includes not only the free acid but also the sulfate salt, sulfoacetate and sulfate ester that may remain in the cellulose ester. The alkali metal (e.g. lithium, sodium, potassium, etc.) and the alkaline earth metal (for example, magnesium,. calcium, strontium, barium and so on) is added as a neutralizer for the catalyst sulfuric acid as well as for the purpose of enhancing the thermal resistance of cellulose esters. Meanwhile, as for the equivalent ratio of residual alkali metal or alkaline earth metal to residual sulfuric acid, U.S. Pat. No. 5,478,386 may be referred to.

The preferred cellulose ester includes organic acid esters (for instance, esters with organic acids having about 2 to 4 carbon atoms) such as cellulose acetate, cellulose propionate, cellulose butyrate, cellulose acetate propionate and cellulose acetate butyrate, among which cellulose acetate is particularly desirable. While the degree of acetylation of cellulose acetate is generally within the rage of about 43% to 62%, those species with combined acetic acid in the range of about 30 to 50% are highly biodegradable. Therefore, the degree of acetylation of the cellulose acetate can be selected from the range of about 30 to 62%.

The coating amount of the cellulose ester in the coated cellulose (A) may for example be, based on the total amount of the coated cellulose, about not less than 0.1% by weight (e.g. about 0.1 to 50% by weight), preferably about not less than 1% by weight (e.g. about 1 to 30% by weight) and more preferably about not less than 5% by weight (e.g. about 5 to 15% by weight). The coated cellulose may practically be coated with the cellulose ester in a proportion of about 0.5 to 15% by weight and preferably about 1 to 12% by weight, typically speaking. If the coating amount is less than 0.1% by weight, the smoking quality and the elimination efficiency of the harmful components tend to be deteriorated, while when it exceeds 50% by weight, the biodegradability or disintegratability is apt to be decreased.

The coated cellulose (A) which is a constituent material of the filter material of the present invention can be obtained by coating or covering the fibrous or particulate cellulose with the cellulose ester. The coating process is effected by a technique which comprises attaching or adhering a solution of the cellulose ester to the surface of the fiber or particle by means of (1) dipping, or (2) spraying, and drying the resultant product (hereinafter referred to as solutiondipping method and solution-spray drying method, respectively); (3) a technique comprising adding a mixture of the fibrous or particle cellulose and a solution of the cellulose ester to a poor solvent for the cellulose ester (hereinafter referred to as mixtureadding method); or (4) a technique comprising spraydrying the mixture mentioned just above (hereinafter referred to as mixture-spray drying method).

The solvent of the cellulose ester solution can be selected from good solvents for the cellulose ester and includes, for example, organic solvents such as acetone, methyl ethyl ketone, dioxane, acetic acid and so forth; and mixed solvents such as an acetone-water mixture, a dichloromethane-alcohol mixture, an acetic acid-water mixture, a methylene chloride-methanol mixture and the like. Acetone can preferably be used as the solvent.

Each of the production methods as mentioned above is now explained in detail.

(1) Solution-dipping Method

This is a method which comprises dipping the fibrous or particulate cellulose to the cellulose ester solution and drying the resultant product to form a coating or covering with the cellulose ester.

The concentration of the cellulose ester in the cellulose ester solution is generally about 0.01 to 30% by weight, preferably about 0.1 to 20% by weight, and more preferably about 0.1 to 10% by weight based on the total amount of the solution. When the concentration exceeds the limit of 30% by weight, the viscosity of the solution is increased and hence the handling properties (workability) are sacrificed. The ratio of the fibrous or particulate cellulose relative to the cellulose ester solution can be selected from a wide range and is usually such that the former : the latter is about 1:10,000 to 1:1 (by weight), and preferably about 1:200 to 1:20 (by weight). The dipping time may suitably be selected from a rage according to the concentration of the cellulose ester solution or other conditions, and is, for instance, about a few seconds or more (e.g. about 3 seconds to 10 minutes and preferably about 5 seconds to 3 minutes).

The dipped cellulose fiber or particle dipped with the cellulose ester solution is subjected to air-drying or drying under heating thus to form a coating on the surface of the cellulose fiber or particle.

(2) Solution-spray Drying Method

It is a method in which the cellulose fiber or particle is sprayed with the cellulose ester solution and the resultant product is dried to form a coating.

In such method, the concentration of the cellulose ester in the cellulose ester solution is generally about 0.01 to 25% by weight (for instance, about 0.1 to 15% by weight), and preferably about 0.5 to 10% by weight (e.g. about 0.1 to 7% by weight). The proportion of the fibrous or particulate cellulose relative to the cellulose ester solution can be selected from a broad range, and is for example such that the former the latter is 1:100 to 1:0.5 (by weight), preferably about 1:20 to 1:1 (by weight) and more preferably about 1:10 to 1:2 (by weight). When a fibrous cellulose such as pulp is utilized, previous cracking of such fibrous cellulose insures homogeneous spraying of the cellulose ester solution. The coated cellulose coated with the cellulose ester on the surface of the fiber or particle can be obtained by air-drying or drying under heating the cellulose fiber or particle sprayed with the cellulose solution.

(3) Mixture-adding Method

This method is described as a method in which a mixture of the cellulose fiber or particle and the cellulose ester solution is added to the poor solvent for the cellulose ester solution with stirring to form a coating.

In this method, the coating can be formed by coagulating or precipitating the cellulose ester solution on the surface of the fiber or particle. In such process, an attachment of an excess amount of the cellulose ester to the surface can be suppressed or inhibited by allowing a shearing force to act on the poor solvent added with the mixture, and hence, the coating of the surface of the fiber or particle can be achieved with high efficiency and homogeneity. The shearing force may generally be rendered to act thereon with the use of a mixer, a homogenizer, a centrifugal pump, a stirrer or the like.

The cellulose ester solution may practically contain the cellulose ester in a proportion of about 0.1 to 30% by weight, preferably about 1 to 25% by weight (e.g. about 1 to 10% by weight) based on the total amount of the solution. Use of the solution containing more than 30% by weight of the cellulose ester may increase the viscosity of the solution, and in particular, when the proportion of the cellulose fiber or particle is large, a homogeneous dispersion or mixing of the fiber or particle can hardly be achieved, and hence the coating efficiency of the fiber or particle surface tends to be decreased.

The content of the cellulose fiber or particle in the mixture is, on a solid basis, about 0.01 to 80% by weight, preferably about 0.1 to 40% by weight, and more preferably about 1 to 20% by weight based on the total amount of the mixture. Practically, the mixture may comprise the cellulose fiber or particle in an amount of about 0.1 to 10% by weight, and preferably about 1 to 5% by weight on a solid basis.

As examples of the poor solvent for the cellulose ester, there may be mentioned water; aromatic hydrocarbons such as benzene, toluene and xylene; aliphatic hydrocarbons such as hexane; alicyclic hydrocarbons such as cyclohexane; and lamp oil (kerosene). The preferred poor solvent includes water. The amount of the poor solvent can be selected from a wide range, and is about 1 to 1,000 times (by weight) and preferably about 10 to 100 times (by weight) than the total amount of the mixture.

(4) Mixture-spray Drying Method

According to this method, the coating can be effected by mixing the fibrous or particulate cellulose and the cellulose ester solution, and spray-drying the resultant mixture.

By way of illustration, in such method, the mixture is sprayed into an air current or air flow (for example an air flow at high temperature) using a spraydryer or the like to coat the surface of the fiber or particle with the cellulose ester.

The concentration of the cellulose ester in the cellulose solution is usually about 0.1 to 30% by weight, and preferably about 1 to 25% by weight (e.g. about 1 to 10% by weight). When the concentration of the cellulose ester exceeds the limit of 30% by weight, the viscosity of the solution is increased and hence, in particular in the case that the ratio of the cellulose ester fiber or particle is high, the fiber or particle can hardly be dispersed or mixed homogeneously and efficient coating of the surface of the fiber or particle can not be achieved. The proportion of the cellulose fiber or particle in the mixture is, for example on a solid basis, about 0.01 to 20% by weight, preferably about 0.1 to 10% by weight and more preferably about 0.5 to 5% by weight based on the total weight of the mixture.

In case that aggregates of the coated cellulose are formed in the drying process of the production of the coated cellulose, such aggregates may preferably be subjected to cracking with the use of a cracking means such as a refiner. Further, the coating amount of the cellulose ester can be controlled by allowing the solvent for the cellulose ester (e.g. in a small amount) to contact with the surface of such aggregates to remove or eliminate the cellulose ester partially, and hence, the size of the aggregate can be decreased.

Incidentally, as described above, the Japanese Patent Publication No. 1944/1969 (JP-B-44-1944) discloses a tobacco filter as produced by impregnating or spraying a paper with a solution containing a hydrophobic polymer and shaping the resultant paper into a rodform. In such tobacco filter, since constituent cellulose fibers or the like are adhered or coated due to addition of the hydrophobic polymer and hence the wet disintegratability of the filter is significantly sacrificed.

To the contrary, according to the present invention, the filter material is prepared by previously coating the constituent fiber or particle with the cellulose ester and then shaping the coated fiber or particle into an intentional form (for example a sheetform). Therefore, the filter material of the present invention is highly disintegratable when wetted, and, further, the aroma and palatability of tobacco smoke can remarkably be improved.

As thus described, the method of the present invention wherein the surface of the fibrous or particulate cellulose is coated with the cellulose ester is characterized in that a coated fiber having a thin or fine fineness or a coated particle having a small particle size can easily be obtained to provide a coated cellulose having a large surface area.

The cellulose derivative (B) is now described in more detail.

The cellulose derivative (B) is in a fibrous or particulate form, in which an esterified portion in the surface layer and a non-esterified portion in the core is formed by esterification of the surface. The esterified portion of the fibrous or particulate cellulose derivative is composed of a cellulose ester. As such ester, those exemplified in the explanation of the coated cellulose (A) may be mentioned.

The esterified portion may preferably be formed or constituted by an organic acid ester (e.g. an ester with organic acid having about 2 to 4 carbon atoms), and in particular by an acetic acid ester.

The average degree of substitution of such fibrous or particulate cellulose derivative may for example be not less than 1.5 (e.g. about 0.01 to 1.5), preferably about 0.02 to 1.2 and more preferably about 0.05 to 0.5. If the average degree of substitution exceeds 1.5, the esterification may excessively proceed, and the core (inner portion) of the fiber or particle would be esterified and hence the biodegradability tends to be sacrificed. When the average degree of substitution is less than 0.01, the characteristics required of a filter such as smoking quality may frequently be sacrificed.

Meanwhile, the term "average degree of substitution" as used in the explanation of the cellulose derivative (B) means the average of degrees of substitution of the cellulose fiber or particle, as a whole, which is esterified heterogeneously, and such meaning or concept is different from that of the term "degree of substitution" as used for a cellulose ester fiber or particle which is manufactured by so-called solubilizing esterification to homogeneous reaction or substitution.

The fiber diameter and fiber length of the fibrous cellulose derivative (B) can suitably be selected from a range as far as the characteristics as required of the filter are not adversely affected, but the fibrous cellulose derivative is practically employed in the form of a short staple. The fibrous cellulose derivative generally has a fiber diameter of about 0.01 to 100 $\mu$m (e.g. about 1 to 50 $\mu$m) and a fiber length of about 50 $\mu$m to 10 mm (for example, about 0.1 to 10 mm and preferably about 0.5 to 4 mm). Use of the cellulose derivative having the fiber diameter and fiber length within the above range can provides the filter material which has a high strength and good moldability.

The cross-sectional configuration of the fibrous cellulose derivative is not particularly restricted and may for example be circular, elliptical or any other configurations. Thus, the fibrous cellulose may be of modified cross-section (e.g. Y-, X-, R- or I-configured) or hollow. The fibrous cellulose may be crimped as necessary and is generally used in the non-crimped form.

The cellulose used in the present invention may preferably be in a fibrous form but particulate (specifically powdery) cellulose may also be employed. The particle size of the particulate cellulose can be selected from a broad range not adversely affecting the moldability (formability) and disintegratability. Thus, the mean particle size of the particulate cellulose is for example about 0.1 to 600 $\mu$m, preferably about 10 to 500 $\mu$m and more preferably about 20 to 250 $\mu$m. If the average (mean) particle size is less than 0.1 $\mu$m, the particles tend to be dislodged from the material, while the surface smoothness of the material tends to be sacrificed and the specific surface area of the material tends to be decreased if it exceeds 600 $\mu$m.

The fibrous or particulate cellulose derivative (B) is esterified on the surface (surface layer) of the fiber or particle and comprises a non-esterified portion in the core (inner portion) of the fiber or particle. In such fibrous or particulate cellulose derivative, the surface of the fiber or particle which contributes or relates to filtration of tobacco smoke is esterified. Therefore, the filtration characteristics of the derivative such as the smoking quality and the elimination efficiency of tobacco smoke are as excellent as those of a conventional filter comprising a tow (fiber bundle) of acetate fibers. Further, since the core of the fiber or particle is not esterified and comprises a non-substituted naturally-occurring or regenerated cellulose, the cellulose derivative has excellent biodegradability, and is biodegradable as highly as a wood pulp or regenerated cellulose fiber or the like. Thus, the cellulose derivative (B) of the present invention, in which functions thereof are shared between the surface layer and the core, is characterized in that the reciprocal characteristics, namely the excellent smoking quality and high biodegradability can be reconciled.

The distribution of esterification of the fibrous or particulate cellulose derivative can be affirmed or ascertained by, for example, dyeing the fibrous or particulate cellulose derivative with a direct dye (substantive color) or a disperse dye, and observing the section of the fiber or particle. That is, an esterified portion (part) can be dyed with the disperse dye, and can not be dyed with the direct dye. To the contrary, a non-esterified and non-substituted portion can be dyed with the direct dye and can not be dyed with the disperse dye. The fibrous or particulate cellulose derivative (B) comprises a portion capable of being dyed with the dispersed phase in the surface (surface layer) of the fiber or particle and a portion capable of being dyed with the direct dye in the core.

The fibrous or particulate cellulose derivative may be derived from a naturally-occurring or regenerated cellulose. As such raw material for the cellulose fiber or particle, there may be mentioned the naturally-occurring or regenerated celluloses as exemplified in the explanation of the coated cellulose (A). These naturally-occurring or regenerated celluloses may be used singly or in combination.

The fibrous or particulate cellulose derivative (B) can be manufactured by, for instance, (5) a method which comprises treating the naturally-occurring or regenerated cellulose fiber or particle with an organic acid anhydride, an organic acid halide or the like in a poor solvent for the cellulose ester such as hexane and toluene and in the presence of a catalyst (hereinafter referred to as catalyst method), (6) a method which comprises treating the naturally-occurring or regenerated cellulose fiber or particle with an organic acid, and an organic acid anhydride or halide, or a technique analogous thereto.

As the catalyst in the catalyst method (5), use may be made of a base such as pyridine; and an alkali metal salt of an organic carboxylic acid such as sodium acetate and potassium acetate. In a conventional manner, an acid catalyst such as sulfuric acid and perchloric acid is used in esterification of a cellulose fiber or particle. However, since these catalysts have strong penetration or permeation force to such cellulose fiber or particle, the fibrous or particulate cellulose derivative in which the surface thereof is esterified with remaining a non-esterified portion in the core can hardly be obtained.

In the method (6), the treatment may be conducted in the presence of a catalyst, but preferably in the absence of such catalyst by using these catalysts. Meanwhile, as the poor solvent for the cellulose ester, those exemplified in the explanation of the coated cellulose (A) may be employed.

According to the method (6) in which the fiber or particle is treated with the organic acid and organic acid anhydride or with the organic acid and organic acid halide in a liquid phase, the surface of the cellulose fiber or particle can be esterified even when the treatment is carried out without a catalyst, and the proceeding or advancement of the esterification to the inner portion (core) of the fiber or particle can be suppressed. Thus, the fibrous or particulate cellulose derivative of the present invention can easily or readily be obtained. Further, use of a solvent such as aromatic hydrocarbons (e.g. hexane, toluene, etc.) is not required in such method, and thus a solvent-treatment process or the like is not necessary and, hence, working conditions are improved. Moreover, the organic acid and organic acid anhydride or halide used in the method are highly biodegradable themselves, and hence, if they should remain in the fibrous or particulate cellulose derivative, the biodegradability of the material would not be deteriorated.

Examples of the organic acid include an aliphatic saturated carboxylic acid having about 2 to 4 carbon atoms such as acetic acid, propionic acid and butyric acid. Such organic acids may be used alone or in combination. The preferred organic acid includes acetic acid, typically speaking.

As the organic acid anhydride or organic acid halide, there may be employed an acid anhydride of the organic acid, or its halide such as a chloride, a bromide, an iodide and so on. If the desired ester is an mixed acid ester, the acid anhydride and/or the acid halide may be used in a suitable combination.

The reaction condition can adequately be selected from a range wherein the surface of the fibrous or particulate cellulose derivative is esterified and yet the esterification does not proceed so far that the core of the fiber or particle is esterified. Thus, the reaction temperature is, generally, about 40 to 120° C. and preferably about 60 to 100° C., and the reaction time is usually about 10 minutes to 10 hours and preferably about 30 minutes to 3 hours.

The amount of the organic acid may be selected from a broad range, and is for example about 5 to 500 times (by weight) and preferably about 20 to 200 times (by weight) relative to the raw material for the cellulose fiber or particle. The proportion of the organic acid anhydride or halide can also be selected from a wide range, and usually is about 5 to 500 times (by weight) and preferably about 20 to 200 times (e.g. 20 to 100 times) (by weight) relative to the raw material for the cellulose fiber or particle.

According to the method as mentioned above, the surface of the cellulose fiber or particle can be esterified, and yet a non-esterified naturally occurring or regenerated cellulose as intact can be remained in the core of the fiber or particle. Therefore, excellent biodegradability can be obtained without deteriorating the smoking quality (aroma, taste, palatability, etc.), as described above. Further, a fine fiber having a small fiber diameter or fine particle having a small diameter can easily be obtained due to esterification of the fibrous or particulate raw material, and hence the filter material having a large specific surface area and high elimination efficiency of harmful components can be obtained.

The coated cellulose (A) and the cellulose derivative (B) of the present invention are highly biodegradable and hence are useful as a raw material in the production of a biodegradable substance such as a biodegradable fiber, paper and filter.

The filter material of the present invention comprises the fiber or particle as mentioned above, that is, the fiber or particle having a core and a surface layer surrounding the core, wherein the surface layer comprises a cellulose ester and the core comprises a non-esterified cellulose, for example, the coated cellulose (A) and/or the cellulose derivative (B). These constituent materials may be used singly or in combination, and a combination of the coated cellulose (A) and the cellulose derivative (B) can also be employed.

The coated cellulose (A), the cellulose derivative (B), and the filter material of the present invention comprising such constituent material are highly biodegradable and show, for example, a 4-week decomposition rate of not less than 20% by weight (e.g. about 30 to 100% by weight), preferably not less than 40% by weight (e.g. about 50 to 100% by weight) as determined using the amount of evolved carbon dioxide as an indicator in accordance with ASTM (American Society for Testing and Materials) D 5209-91. In the determination of biodegradability, an active sludge of a municipal sewage treatment plant may be used as an active sludge. The decomposition rate of the fibrous or particulate cellulose derivative can be found by converting the amount of evolved carbon dioxide to the number of carbon atoms and calculating its percentage relative to the total number of carbon atoms available prior to decomposition. These material and constituent material are also highly degradable by an enzyme such as a cellulase.

The morphology of the material is not specifically restricted, and is, for example, in the form of a fiber, trichome (fur or wool), woven fabric, nonwoven fabric, tow (fiber bundle) or sheet. The preferred material includes a sheet-like material having a nonwoven web structure. Meanwhile, the term "web structure" is used herein to mean a textural structure in which fibers are interlaced or entangled. For the above reason, the sheet-like filter material has a high dry paper strength and yet disintegrates itself rapidly when wetted with rain water or the like.

The filter material can be manufactured, for example, by (1) a method in which a composition comprising the coated cellulose (A) and/or the cellulose derivative (B) is shaped by packing as intact or by molding into a web-like sheet to give the filter material, (2) a method in which a slurry containing a composition comprising the coated cellulose and/or the cellulose derivative is wet webbed into a sheet form to give a filter material in the form of a sheet.

The filter material of the present invention may further comprise other component than the fiber or particle within a range insofar as the characteristics are not adversely affected. As such component capable of using together with the constituent material, namely the fiber or particle, there may be mentioned, for example, the naturally-occurring or regenerated cellulose fibers exemplified as the raw material of the cellulose fibers; naturally-occurring fibers such as wool; synthetic fibers such as a cellulose ester fiber, an polyolefin fiber (for example, a polyethylene fiber or polypropylene fiber), a polyester fiber (e.g. a polyethylene terephthalate fiber), a polyvinyl alcohol fiber, a polyamide fiber and the like. These components can also be used in the form of a particle, and be employed alone or in combination. The naturally-occurring or regenerated fiber, especially a wood pulp can advantageously be used for its high biodegradability.

The ratio of the fiber or particle to the other component can suitably be selected from a broad range as far as the characteristics of the filter material such as the smoking quality and the biodegradability are not sacrificed, and is, for example, such that the former/the latter is about 99/1 to 20/80 (by weight), preferably about 99/1 to 40/60 (by weight) and more preferably about 98/2 to 60/40 (by weight). The ratio may practically be about 95/5 to 80/20 (by weight).

The proportion of the fiber or particle in the filter material can be selected from a wide rage within which the characteristics such as the biodegradability are not adversely affected, and is, for instance, not less than 30% by weight (e.g. about 40 to 100% by weight), preferably not less than 50% by weight (e.g. about 55 to 100% by weight) and more preferably not less than 60% by weight (e.g. about 65 to 100% by weight) based on the total weight of the filter material.

The fiber or particle and the filter material may comprise a variety of additives as far as not deteriorating the characteristics thereof. Examples of such additive include sizing agents; finely divided powers of inorganic substances including kaolin, talc, diatomaceous earth, titanium dioxide, alumina, quartz, calcium carbonate and barium sulfate; stabilizers such as thermal stabilizers including salts of alkaline earth metals (calcium, magnesium, etc.), antioxidants and ultraviolet ray absorbents; colorants; and yield improvers. Further, incorporation of a paper-strength reinforcing agent such as a microfibrillated cellulose (e.g. a microfibrillated cellulose having a specific surface area of about 100 to 300 $m^2/g$, a fiber diameter of not more than 2 $\mu$m, preferably not more than 1 $\mu$m and a fiber length of about 50 to 1,000 $\mu$m) can enhance the dry paper strength. Furthermore, the environmental degradation of the filter material can be increased together with the high biodegradability or disintegratability as mentioned above by incorporating a biodegradation accelerator such a citric acid, tartaric acid, malic acid and the like and/or a photodegradation accelerator such as an anatase-form titanium dioxide.

The filter material may comprise a plasticizer such as triacetin or triethylene glycol diacetate as far as the characteristics of the material such as the disintegratability and the biodegradability, but preferably, the filter material does not contain such plasticizer for emphasizing wet disintegratability and hence improving the degradation or decomposition of the filter.

The filter material may contain an adhesive as necessary. In such case, use of a water-soluble adhesive is desirable for increasing the wet disintegratability. As the water-soluble adhesive, there may be mentioned, for example, natural adhesives such as starch, modified starch, soluble starch, dextran, gum arabic, sodium alginate, protein (e.g. casein, gelatin, etc.); cellulose derivatives such as carboxymethylcellulose, hydroxyethylcellulose, ethylcellulose and the like; and synthetic resin adhesives such as polyvinyl alcohol, polyvinylpyrrolidone, water-soluble acrylic resin and so on. These adhesives may be employed independently or in combination.

When the water-soluble adhesive is used in the form of an aqueous solution or dispersion, it may happen, depending on the amount of the aqueous solvent used, that the strength and firmness of the filter rod are sacrificed and even that not only the workability of wrapping of the filter material with a wrapping paper but also that of cutting the rod into filter tips is remarkably impaired. Particularly where an aqueous solution of the water-soluble adhesive is applied to the fiber or particle as the constituent component by dipping, the strength and firmness of the material are considerably decreased. Therefore, where the watersoluble adhesive is used in the form of an aqueous solution or dispersion, it is advantageous; to reduce the amount of water added to the fiber or particle. On the other hand, a hot-melt adhesive (water-soluble hot-melt adhesive) which develops an adhesive power on melting-solidification is a solventless adhesive and, therefore, has nothing to do with the above troubles. The water-soluble adhesive of this type (water-soluble hot-melt adhesive) includes those polymers showing hot-melt adhesiveness, as represented by polyvinyl alcohol, polyalkylene oxides, polyamides, polyesters and acrylic polymers.

The tobacco filter material of the present invention is highly biodegradable as mentioned above, and is useful for the manufacture of tobacco smoke filters (tobacco filter rods). The tobacco filter mentioned above can be manufactured by the conventional manufacturing process, for example by (a) a process comprising charging a filter rod forming die with the filter material in the form of a fiber, powder or the like, as intact, to form a filter plug, or (b) a process comprising winding or folding the sheet-like material spirally with the use of a plug winding machine to give a filter plug. According to the process (b), the drying may be conducted after shaping the sheet-like material by winding or folding, or, alternatively, the sheet like material may previously be dried before the shaping process.

The filter material is preferably creped or embossed for insuring a smooth and uniform passage of tobacco smoke through the filter plug without channeling. By wrapping up the creped or embossed filter material, a filter plug having a homogeneous cross section and an attractive appearance can be obtained. The creping can be effected by passing the sheet material through a pair of creping rolls formed with a multiplicity of grooves ruining in the direction of advance to thereby form winkles or creases and, to a lessor extent, fissures in the sheet along the direction of its advance. The embossing can be conducted by passing the sheet material over a roll formed with a grate or random relief pattern having convex and/or concave portions or pressing the sheet material with a roller formed with such a relief pattern.

The pitch and depth of the grooves for creping and the pitch and depth of the embossing pattern can be selected from the range of about 0.3 to 5 mm (e.g. about 0.5 to 5 mm) for pitch and the range of about 0.1 to 2 mm (e.g. about 0.1 to 1 mm) for depth.

The filter material in the form of a sheet has advantages such that the characteristics such as pressure drop (puff resistance) and adsorption and elimination rate can be controlled. Further, by the creping or embossing, a filter having an adequate permeability (puffing properties) for tobacco smoke can be effected.

By way of illustration, by the creping or embossing, there can be obtained a filter having a satisfactory permeability to tobacco smoke, for example having a pressure drop (puff resistance) of about 200 to 600 mm WG (Water Gauge) and preferably about 300 to 500 mm WG (mm $H_2O$ or mm Aq).

In the plug forming machine mentioned above, the creped or embossed sheet-like filter material is set in a funnel, wrapped up with wrapping tissue or paper into a cylinder, glued and cut to length to provide filter plugs. In wrapping, the creped sheet-like filter material is practically wrapped in a direction substantially perpendicular to the lengthwise direction of the creases or wrinkles.

In the manufacture of filter plugs, where the gluing along edges of the wrapping paper formed into a cylinder and gluing between the cylindrical filter material and wrapping paper are necessary, a water-soluble adhesive is preferably used as the glue in order that the wet disintegratability will not be adversely affected. Such water-soluble adhesive that can be used includes, for example, those as mentioned above. These water-soluble adhesives may be employed alone or in combination.

With the tobacco smoke filter described above, the gratifying aroma (taste) and palatability of the tobacco smoke can be well retained. That is, the constituent fiber or particle of, for example, the coated cellulose (A) and/or cellulose derivative (B) can provide excellent smoking quality and be highly biodegradable and, practically wet disintegratable. Accordingly, even if the filter is discarded outdoors, it is rapidly decomposed on contact with rain water or the like, thus reducing the risk of pollution.

The intentional biodegradation of the filter can be carried out under outdoor exposure conditions, for example at temperatures from about 0 to 50° C., preferably from about 10 to 40° C., and about 30 to 90% relative humidity. To accelerate the biodegradation of the filter, it is instrumental to expose the filter to the soil or water containing microorganisms adapted or acclimatized to the cellulose and organic acid which are constituents of the cellulose ester. Using an active sludge containing such microorganisms, an enhanced biodegradability of the filter can be expected.

Since the tobacco filter material and tobacco filter of the present invention comprises the fiber or particle having a core comprising a cellulose ester and a surface layer surrounding said core and comprising a non-esterified cellulose does not deteriorate smoking and provides biodegradability and hence, alleviate the pollution burden on the environment. Further the filter material and filter can provide high filtration efficiency. Moreover, when the filter material and the filter comprise, for example, the coated cellulose (A), high wet disintegratability can also be obtained, and moreover, despite the high dry paper strength, they disintegrate themselves readily and fast when wetted. Further, they insure an efficient elimination of harmful components in tobacco smoke and has an adequate puff resistance (pressure drop), and excellent moldability and biodegradability.

By the process of the present invention, a tobacco filter material having the above-mentioned meritorious characteristics can be manufactured.

The following examples are intended to describe this invention in further detail and should by no means be construed as defining the scope of the invention.

EXAMPLES

Disintegratability, freeness, weight, coating amount, average degree of substation, viscosity-average degree of polymerization and puff resistance in the examples and comparative examples were evaluated by the following methods.

Water disintegratability (%): About 0.2 g of a sample was accurately weighed, put in a 1-liter beaker (110 mm in outer diameter, 150 mm in height) containing 500 ml of water and stirred with a magnetic stirrer so that the center height of the vortex would be equal to ½ of the highest liquid level. After 30 minutes, the slurry was filtered through a 5-mesh metal screen and the dry weight of the filter cake was determined. Then, the water disintegratability (%) was calculated by means of the following equation for the assessment of wet disintegratability.

$$\text{Water disintegratability (\%)} = 100 \times [1-(B/A)]$$

wherein A represents the weight (g) of the sample and B represents the dry weight (g) of the filter cake.

Canadian standard freeness (ml) : Japanese Industrial Standards (JIS) P-8121

Weight ($g/m^2$): JIS-P-8124

Coating amount (% by weight): The raw material fiber or powder was weighed accurately, and coated with a cellulose acetate. The obtained coated cellulose was dried at 105° C. for 2 hours and weighed. The coating amount of the cellulose acetate was determined by calculating an increase amount of the weight according to the following equation.

$$\text{Coating amount (\% by weight)} = 100 \times [(D-C)/D]$$

wherein C represents the weight (g) of the raw material cellulose (wood pulp) (g), and D represents the weight (g) of the coated cellulose.

Average degree of substitution: Acetone (120 ml) and dimethylsulfoxide (30 ml) were added to 1.9 g of a sample for swelling, and afterwards, 30 ml of an aqueous solution of 1N-NaOH was added to the resultant mixture, and saponification was conducted at room temperature for 2 hours with stirring. After completion of the reaction, the resultant mixture was added with 100 ml of hot water and stirred for 5 minutes, and 25 ml of purified water was added to the mixture. Thus, the average degree of substitution was evaluated by means of back titration of consumed alkali with an aqueous solution of 1N-$H_2SO$ with the use of phenolphthalein as an indicator.

Viscosity-average degree of polymerization: A dried sample (0.5000 g) was weighed accurately (C) and put in a 100 ml-measuring flask. To the sample was added about 70 ml of acetone to give a solution. The solution was adjusted at 25° C. and acetone was further added to the solution up to 100 ml. In an Ostwald's viscosimeter was put 10 ml of the resultant solution. Dropping times from the viscometer were determined for the solution and the solvent (acetone) at 25° C. with an accuracy of 0.01 second-level, respectively, and the viscosity-average degree of polymerization (DP) was calculated by the following formulae.

$$[\eta]=(\eta sp/C)/(1+k\times\eta sp)$$

$$\eta sp=t/t_0-1$$

$$k=0.366$$

$$DP=169.93\times[\eta]_{1.623}$$

where t represents a dropping time (second) of the solution of cellulose ester, to represents a dropping time (second) of the solvent (acetone), and C shows a weight of the sample (cellulose ester).

Puff resistance: The filter was connected to a vacuum pump being parallel with a U-figure tube water column gauge, and the puff resistance was represented by a scale of the water column gauge (Water Gauge, $H_2O$) when the amount of air passing through the filter was 17.5 ml per second.

Biodegradability was determined by the following two methods.

(1) Active sludge method: According to ASTM D 5209-91, the active sludge of a municipal sewage treatment plant was used as the active sludge. As the test sample, 2 grams of each test material was preliminarily frozen in liquefied nitrogen for 3 minutes and then ground in a coffee mill for 3 minutes. The ground material was frozen in liquefied nitrogen for 1 minute and then pulverized with a vibrating pulverizer for 3 minutes to give a test sample (100 mesh pass).

Using the test sample at a concentration of 100 ppm (charge 30 mg) and said active sludge at a concentration of 30 ppm (charge 9 mg), the test was carried out at 25±1° C. for 4 weeks. The amount of evolved carbon dioxide was converted to the number of liberated carbon atoms and the decomposition rate was calculated as the percentage relative to the total number of carbon atoms in the test sample.

(2) Enzymatic decomposition method: This is a method for determining a degradability (decomposition property) caused by an enzyme. That is, 0.1 g of a sample was added to 20 ml of a buffer (pH 4.8) containing 288 CUN of cellulase [Cellcrast 1.5N (trade name), manufactured by Novo Nordisk Bioindustries, Ltd.], and the resultant mixture was subjected to a reaction at 45° C. for 7 hours with stirring. After completion of the reaction, the reaction mixture was filtrated with a G4-glass filter and the residue was dried, and the sample weight after the reaction was determined. The residual rate of the sample was then calculated in accordance with the following equation.

$$\text{Residual rate } (\%)=[x/0.1]\times 100$$

wherein x represents the sample weight (g) after the reaction.

Smoking quality test was effected as follows. A sample which was previously shaped into a filter plug was attached to a cigarette [an entity obtained by removing a filter plug from a cigarette on the market (trade name: Wakaba, manufactured by Japan Tobacco Inc.)], and using such sample, the smoking quality test was conducted employing 5 habitual smokers, as subjects and the aroma (taste) and palatability were evaluated in accordance with the following criteria, and the aroma and palatability grade of the sample were shown as a mean value of the evaluation values of the 5 subjects.

Evaluation Criteria

Aroma and palatability grade 3: The tobacco smoke smoked through the sample has not hot (pungent) taste (aroma) and is palatable as a tobacco Aroma and palatability grade 2: The tobacco smoke has not pungent taste but is not so palatable Aroma and palatability grade 1: The tobacco smoke has pungent taste

Example 1

To 500 ml of an acetone solution containing 0.15% by weight of a cellulose acetate (degree of acetylation of 55.5%, average degree of substitution of 2.45, residual calcium-to-residual sulfuric acid mol ratio of 1.2, mean polymerization degree of 370) was dipped 10 g of a bleached soft wood kraft pulp with Canadian standard freeness value of 270 ml for 15 seconds with stirring, where the pulp had been obtained by cracking with water and substituting with acetone, for 15 seconds with stirring. The dipped pulp was taken out and airdried to give coated fibers coated with cellulose acetate on the surface. The coating amount of the cellulose acetate in the coated fibers was 5.0% by weight based on the total weight of the coated fiber. The obtained coated fibers were uniformly dispersed in 50 liters of water, and using the resultant slurry, a web was fabricated according to a conventional wet fabricating technique. This web was dehydrated and dried to provide a sheet weighing 30 g/$m^2$. The sheet had a water disintegratability of 65.9%. As for the biodegradability, the sheet showed a 4-week decomposition rate of 63% according to the active sludge method, and a residual ratio of 72.2% in the enzymatic decomposition method.

Example 2

To 400 ml of an acetone solution containing 3.0% by weight of a cellulose acetate (degree of acetylation of 55.5%, average degree of substitution of 2.45, residual calcium-to-residual sulfuric acid mol ratio of 1.2, mean polymerization degree of 370), was added, with stirring, 10 g of a bleached soft wood kraft pulp with a Canadian standard freeness value of 270 ml obtained by cracking with water and subjecting the resultant with acetone, and the solvent was removed off by filtration. The obtained mixture was thrown into a water bath imparted with a sufficient stirring forth with the use of a mixer, and, thus, the cellulose acetate was coagrated or solidified. The resultant was airdried to provide coated fibers coated with cellulose acetate on the surface. Using the obtained fibers, a web was fabricated in the same manner as Example 1 in accordance with a conventional technique, and was dehydrated and dried to give a sheet weighing 34.1 g/m$^2$. As a result of investigating the disintegratability and biodegradability, the sheet demonstrated a water disintegratability of 63.2%, a decomposition rate of 63% in the active sludge method and a residual ratio of 71.5% in the enzymatic decomposition method.

Example 3

The procedure of Example 2 was repeated except for using an acetone solution containing 5.0% by weight of cellulose acetate to provide coated fibers coated with cellulose acetate in an amount of 9.7% by weight. Using the coated fibers thus obtained, a sheet weighing 34.6 g/m$^2$ was produced in the same manner as Example 1. The disintegratability and biodegradability of the sheet were determined and, as a result, the sheet showed a water disintegratability of 60.2%, a decomposition rate in the active sludge method of 59% and a residual ratio in the enzymatic decomposition of 72.1%.

Example 4

Thirty (30.0) gram of a powdery cellulose (a cracked and bleached soft wood kraft pulp; 60 mesh pass) was added to 1 liter of an acetone solution containing 5.0% by weight of a cellulose acetate (degree of acetylation of 55.5%, average degree of substitution of 2.45, residual calcium-to-residual sulfuric acid mol ratio of 1.2, mean polymerization degree of 370), and homogeneously dispersed by stirring with a mixer. The resultant mixture was pushed, at a rate of 1 mm per second, from a nozzle having a diameter of 1 mm into a water bath, said water bath being stirred with a vane (blade) rotating at a rate of 10,000 rpm, and thereby coated fibers coated with the cellulose acetate on the surface in a proportion of 9.76% by weight were prepared. A sheet weighing 25.0 g/m$^2$ was obtained using the coated fibers in a similar manner to Example 1. The water disintegratability of the sheet was 58.6%, and as to the biodegradability, the sheet showed a 4-week decomposition rate in the active sludge method of 60% and a residual ratio in the enzymatic decomposition method of 76.4%.

Example 5

To 1 liter of an acetone solution containing 1.0% by weight of a cellulose acetate (degree of acetylation of 55.5%, average degree of substitution of 2.45, residual calcium-to-residual sulfuric acid mol ratio of 1.2, mean polymerization degree of 370), was added 10 g of powdery cellulose (obtained from a bleached soft wood sulfite pulp, 330 mesh pass), and the resultant mixture was homogeneously dispersed with stirring by using a mixer to give a mixture. The mixture was sprayed and dried in an air flow at 100° C. using a spray drier to give a cellulose powder coated with the cellulose acetate on the surface thereof. The proportion of the cellulose acetate in the coated powder was 10.2% by weight. Using the obtained coated powder, a web was wet-fabricated in the same manner as Example 1. This web was dehydrated and dried to provide a sheet weighing 25.0 g/m$^2$. The disintegratability and biodegradability of the sheet were determined, and resultantly, the sheet showed a water disintegratability of 61.2%, decomposition rate in the active sludge method of 60% and a residual ratio in the enzymatic decomposition method of 73.0%.

Example 6

Ten (10) gram of a bleached soft wood kraft pulp obtained by cracking with water and substituting the resultant with acetone was sufficiently crumpled and untangled. To the surface of the untangled pulp was sprayed 30 g of an acetone solution containing 1.0% by weight of a cellulose acetate (degree of acetylation of 55.5%, average degree of substitution of 2.45, residual calcium-to-residual sulfuric acid mol ratio of 1.2, mean polymerization degree of 370), and was air-dried to give coated fibers wherein the surface of the fibers were coated with the cellulose acetate in a proportion of 1.8% by weight based on the total weight of the coated fibers. From the coated fibers, a web was wetfabricated in the same manner as Example 1, and the web was dehydrated and dried to provide a sheet weighing 28.4 g/m$^2$. By determining the disintegratability and biodegradability of the sheet, the sheet showed a water disintegratability of 64.8%, a decomposition rate in the active sludge method of 66% and a residual ratio in the enzymatic decomposition method of 70.1%.

Example 7

Coated fibers coated with 5.7% by weight of the cellulose acetate were obtained in the same manner as Example 6 except that an acetone solution having a cellulose acetate content of 3.0% by weight. By using the coated fibers, a sheet weighing 29.0 g/m$^2$ was obtained in the same manner as Example 1. The disintegratability and biodegradability of the sheet were determined, and thus the sheet indicated a water disintegratability of 62.2%, a decomposition rate in the active sludge method of 65% and a residual ratio in the enzymatic decomposition method of 71.6%.

Example 8

The procedure of Example 6 was repeated except for using an acetone solution containing 5.0%; by weight of the cellulose acetate to give coated fibers (coating amount of the cellulose acetate: 9.4% by weight). A sheet weighing 28.6 g/m$^2$ was obtained by using the coated fibers obtained above in accordance with the same manner as Example 1. The water disintegratability, the decomposition rate in the active sludge method and the residual ratio in the enzymatic decomposition method were 56.1%, 61% and 73.5%, respectively Comparative Example 1

By using the same bleached soft wood kraft pulp as used in Example 1 and no other, a web was wet-fabricated in accordance with a conventional manner and the web was dehydrated and dried to provide a sheet weighing 29.5 g/m$^2$. As a result of evaluation of the disintegratability and biodegradability of the obtained sheet, the sheet indicated a water disintegratability of 69.7%, and, as for the biodegradability, a decomposition rate of 73% in the active sludge method and a residual ratio of 54.3% in the enzymatic decomposition method.

Comparative Example 2

The biodegradability of a crimped cellulose acetate short staple fiber of Y-cross section (fineness of 3 deniers, fiber length of 5 mm, degree of acetylation of 55.5%, average degree of substitution of 2.45, residual calcium-to-residual sulfuric acid mol ratio of 1.2, mean polymerization degree of 370) was determined, and, as a result, the fiber showed a decomposition rate of 6% in the active sludge method and a residual ratio of 96.8% in the enzymatic decomposition method.

Example 9

The sheet-like filter material having a width of 28 cm obtained in Example 1 was creped with the use of a creping roll (surface temperature of 150° C., groove pitch of 2.0 mm, groove depth of 0.7 mm) at a speed of 100 m/min. The material showed a good processability. This creped filter material was worked up at a rate of 250 m/min. without addition of a plasticizer, and, thereby, a filter plug was fabricated. This filter plug measuring 108 mm long by 23.5 mm in circumference had a plug weight of 1.05 g/plug.

Examples 10 to 16

Filter plugs were fabricated in the same manner as Example 9 except for using the sheet-like filter materials obtained in Examples 2 to 8, respectively.

Comparative Example 3

The procedure of Example 9 was repeated except for employing the sheet-like filter material obtained in Comparative Example 2 to give a filter plug.

Comparative Example 4

A filter plug (108 mm in length, 23.5 mm in circumference, weighing 1.10 g/plug) was obtained in the similar manner as above except that a bundle of the same cellulose acetate short staple fibers as Comparative Example 2, and triacetin as a plasticizer were used.

The disintegratability and smoking quality of each of the filter plugs obtained in Examples 9 to 16 and Comparative Examples 3 and 4 respectively were evaluated. The results are set forth in Table.

TABLE

| | Water disintegratability (%) | Aroma and palatability grade |
|---|---|---|
| Example 9 | 67.6 | 2.6 |
| Example 10 | 65.6 | 2.8 |
| Example 11 | 61.8 | 2.4 |
| Example 12 | 60.2 | 2.2 |
| Example 13 | 62.8 | 2.6 |
| Example 14 | 66.4 | 2.8 |
| Example 15 | 63.5 | 2.6 |
| Example 16 | 57.7 | 2.4 |
| Com. Ex. 3 | 71.8 | 1.2 |
| Com. Ex. 4 | 4.0 | 2.8 |

As apparent from the Table, the filters obtained in Examples 9 to 16 were superior to the filter obtained in Comparative Example 4 in the water disintegratability, and superior in the smoking quality to the filter obtained in Comparative Example 3 and was equal in such smoking quality to the filter obtained in Comparative Example 4.

Example 17

In 1,000 ml of water was dipped 10 g of a soft wood sulfide pulp (α-cellulose content of 94%) for 1 hour and the dipped pulp was dehydrated up to containing 5 times of water relative to the pulp, and the resultant was substituted with 100 ml of acetic acid. Further, 600 ml of acetic acid and 600 ml of acetic anhydride were added to the above-mentioned mixture and the reaction was carried out under a nitrogen gas flow using an oil bath at 80° C. for 1 hour. The reaction mixture was thrown into 3,000 ml of water, and thus excess of acetic anhydride was decomposed. The resultant mixture was filtrated, washed with water and dried to give a fibrous cellulose derivative (fiber length of 4 mm, fiber diameter of 20 μm) with an average degree of substitution of 0.15. The biodegradability of the cellulose derivative in the active sludge method was 61%. The fibrous cellulose derivative was dyed with a disperse dye (Disperse Yellow 3, manufactured by Aldrich Chemical Company Inc.) and cross section of the fiber was observed with the use of a microscope. As a result, only the outer region (surface layer) of the fiber was dyed with the dye, and hence it was confirmed that only the surface layer of the fiber was acetylated.

Comparative Example 5

The biodegradability of a cellulose acetate fiber (fineness of 3 deniers, Y-cross section) with an average degree of substitution of 2.4 as used in a marketed tobacco filter was determined. Resultantly, the fiber showed a decomposition rate of 2% in the active sludge method.

Example 18

A filter tip wrapping paper with 7.9 mm in inner diameter and 17 mm in length was charged with the fibrous cellulose derivative obtained in Example 17, and a tobacco smoke filter plug with a pressure drop of 50 mm Water Gauge. The smoking quality of the filter plug was evaluated according to the smoking quality test, and as a result, the aroma and palatability grade of the plug was 2.8.

Example 19

In 10,000 parts by weight of water was dispersed 90 parts by weight of the fibrous cellulose derivative obtained in Example 17 and 10 parts by weight of a bleached soft wood kraft pulp to give a homogeneous slurry, and the slurry was dehydrated with the use of a perforated panel, and was dried to provide a sheet weighing 35 g/m$^2$. The sheet was molded into a corrugated form, and the corrugated sheet was charged to a filter tip wrapping paper having inner diameter of 7.9 mm and length of 17 mm to provide a filter plug with a pressure drop of 50 mm Water Gauge. The filter plug was subjected to the smoking quality test, and as a result, the aroma and palatability grade of the filter was 2.6.

Comparative Example 6

By using a bleached soft wood kraft pulp and no other, a filter plug (inner diameter of 7.9 mm, length of 17 mm, puff resistance of 50 mm WG) was manufactured in a similar manner to Example 19. The smoking quality test was effected by using the filter plug, and, as a result, the aroma and palatability degree of the filter plug was 1.2.

What is claimed is:

1. A method for producing a tobacco filter material, which comprises a treating process for treating a naturally-occurring or regenerated cellulose fiber with an organic acid and an organic acid anhydride or organic acid halide in a liquid phase to give an esterified cellulose fiber, wherein said fiber comprises a core and a surface layer surrounding the core, and the surface layer is esterified and the core is non-esterified.

2. A method for producing a tobacco filter material as claimed in claim 1, wherein said treating process is carried out in the absence of a catalyst.

3. A method for producing a tobacco filter material as claimed in claim 1, wherein said esterified cellulose fiber as a whole has an average degree of substitution of not more than 1.5.

4. A method for producing a tobacco filter material as claimed in claim 1, wherein said esterified cellulose fiber is at least one member selected from the group consisting of cellulose acetate, cellulose propionate, cellulose butyrate, cellulose acetate propionate and cellulose acetate butyrate.

5. A method for producing a tobacco filter material as claimed in claim 1, wherein said esterified cellulose fiber is a cellulose acetate.

6. A method for producing a tobacco filter material as claimed in claim 1, wherein the non-esterified cellulose of said core is wood pulp.

7. A method for producing a tobacco filter material as claimed in claim 1, wherein said core comprises a non-esterified wood pulp and said surface layer comprises a cellulose ester, wherein the cellulose ester of said surface layer has an average degree of substitution of 1 to 3, and the amount of said cellulose ester is 0.1 to 50% by weight based on the total weight of said esterified cellulose fiber.

8. A method for producing a tobacco filter material as claimed in claim 1, wherein said esterified cellulose fiber as a whole has an average degree of substitution of 0.02 to 1.2.

9. A method for producing a tobacco filter material as claimed in claim 1, wherein said esterified cellulose fiber is biodegradable.

10. A method for producing a tobacco filter material as claimed in claim 1, wherein said esterified cellulose fiber has a 4-week decomposition of not less than 20% by weigh t as determined using the amount of evolved carbon dioxide as an indicator in accordance with ASTM D 52-09-91.

11. A method for producing a tobacco filter material as claimed in claim 1, wherein said esterified cellulose fiber is a fiber having a fiber diameter of from 0.01 to 100 $\mu$m and a fiber length of from 50 $\mu$m to 10 mm.

* * * * *